US005293176A

United States Patent [19]

Elliot

[11] Patent Number: 5,293,176

[45] Date of Patent: Mar. 8, 1994

[54] FOLDED CROSS GRID DIPOLE ANTENNA ELEMENT

[75] Inventor: Paul G. Elliot, Vienna, Va.

[73] Assignee: APTI, Inc., Washington, D.C.

[21] Appl. No.: 793,657

[22] Filed: Nov. 18, 1991

[51] Int. Cl.[5] ..... H01Q 21/26

[52] U.S. Cl. ..... 343/797; 343/807

[58] Field of Search ..... 343/795, 797, 846, 803, 343/798, 726, 730; H01Q 21/26

[56] References Cited

U.S. PATENT DOCUMENTS

| | | | |
|---|---|---|---|
| 3,196,443 | 7/1965 | Martin | 343/797 |
| 3,273,158 | 9/1966 | Fouts et al. | 343/797 |
| 4,758,843 | 7/1988 | Agrawal et al. | 343/795 |
| 4,922,263 | 5/1990 | Dubost et al. | 343/797 |
| 5,075,691 | 12/1991 | Garay et al. | 343/797 |

OTHER PUBLICATIONS

Ayzenberg, Shortwave Antennas, State Publishing House for Literature on Questions of Communications and Radio, Moscow 1962.

Antenna Theory Analysis and Design, C. Balanis, West Virginia University, pp. 330–332.

Antenna Engineering Handbook Second Edition, R. Johnson et al., pp. 4–12 to 4–18, 28–10 to 28–11 and 20–17 to 20–21.

Modern Antenna Design, T. Milligan, Martin Marietta Denver Aerospace, pp. 340–346.

*Primary Examiner*—Michael C. Wimer
*Assistant Examiner*—Tan Ho
*Attorney, Agent, or Firm*—Foley & Lardner

[57] ABSTRACT

A wide bandwidth, wide scan, antenna array element provides an active element impedance close to 350 ohms over a bandwidth approaching one octave in a periodic equilateral triangular array lattice. The two balanced feed inputs to each element may be phased to produce any desired polarization. The interelement spacing is the maximum possible for grating lobe free operation. This antenna element combines features of a crossed grid dipole with a folded dipole. The antenna structure consists of conductors lying in two planes which are parallel to a ground plane. These are joined by a limited number of perpendicular conductors. The VSWR remains below 2:1 in a 300 or 350 ohm system for scan in any direction out to 30 degrees off of broadside over a bandwidth approaching one octave.

28 Claims, 13 Drawing Sheets

350 Ω CHART

□ .59 fo
○ .69 fo
△ .80 fo
+ .90 fo
× fo

350 Ω CHART

□ .59 fo
○ .69 fo
△ .80 fo
+ .90 fo
× fo

350 Ω CHART

□ .59fo
○ .69fo
△ .80fo
+ .90fo
× fo

350 Ω CHART

□ .59 fo
○ .69 fo
△ .80 fo
+ .90 fo
× fo

350 Ω CHART

□ .59fo
○ .69fo
△ .80fo
+ .90fo
× fo

350 Ω CHART

□ .59fo
○ .69fo
△ .80fo
+ .90fo
× fo

350 Ω CHART

□ .59 fo
○ .69 fo
△ .80 fo
+ .90 fo
× fo

350 Ω CHART

□ .59fo
○ .69fo
△ .80fo
+ .90fo
× fo

FOLDED CROSS GRID DIPOLE ANTENNA ELEMENT

BACKGROUND OF THE INVENTION

1. Field of the Invention

The invention relates to antenna elements, generally, and particularly to an antenna element which provides arbitrary polarization and can be used to form a scanning array with a minimum number of elements while maintaining relatively constant active element input impedance over bandwidths approaching one octave.

2. Related Art

Crossed dipole (or turnstile antennas), folded dipoles and wire biconical antennas have been used alone and in arrays in a variety of communications and radar applications. C. Balanis in *Antenna Theory Analysis and Design* (1982) discloses at page 330 that biconical antennas have broadband characteristics useful in the VHF and UHF frequency ranges, but that the size of the solid shell biconical structure limits many practical applications. As a compromise, multielement intersecting wire bow tie antennas have been employed to approximate biconical antennas. Johnson and Jasik in the *Antenna Engineering Handbook* (1984) disclose crossed dipole antennas at page 28-10. Such antennas are used for producing circular polarization. Johnson at Jasik at page 4-12 also disclose biconical dipoles and, beginning at page 4-13, disclose the formation of folded dipoles by joining cylindrical dipoles at their ends and driving them by a pair of transmission lines at the center of one arm.

To date, however, there has been no disclosure of an antenna element that combines the desirable features of the biconical, crossed dipole and folded dipole antenna elements.

SUMMARY OF THE INVENTION

In view of the above described related art limitations, and others, it is an object of the invention to provide an antenna which minimizes the number of elements for grating lobe free operation over a conical scan volume.

It is another object of the invention to maintain a wide impedance bandwidth.

It is still a further object of the invention to provide an array antenna element which provides arbitrary polarization and permits the minimum number of array elements for a scanning array, while maintaining a relatively consistent active element impedance over a wide bandwidth, approaching one octave.

It is another object of the invention to provide an antenna element formed as a crossed grid dipole element from a pair of folded grid dipoles.

It is still another object of the invention to combine in a single antenna the features of a crossed dipole or turnstile antenna, the folded dipole and the wire biconical antenna, with improved bandwidth performance.

The above and other objects of the invention are accomplished with an antenna element having a two tier construction, with conductors in each tier being parallel to an X-Y plane. The element is formed from four grid dipoles (two crossed grid dipoles). Each tier has two dipoles (one crossed dipole) formed from a grid of conductors. Each grid dipole has an axial conductor with additional peripheral conductors around a perimeter producing a wide grid dipole shape. All the conductors on the top tier converge at a center and are connected to improve performance, which is another novel feature of this element. Each dipole is 0.612λ long at the reference frequency. Typically, each element has four arms with each arm being shaped as a quadrilateral. In this configuration, the lower and upper tiers are connected at 12 points on the periphery of the element. The arms may be shaped as polygons other than a quadrilateral.

BRIEF DESCRIPTION OF THE DRAWINGS

The invention will be understood in accordance with the description of the embodiments herein with reference to the drawings in which.

DETAILED DESCRIPTION OF THE PREFERRED EMBODIMENTS

An antenna element according to the invention has a ground plane and a first crossed grid dipole, arranged in an X-Y plane corresponding to a first tier, the first tier being vertically separated from a second tier and the ground plane. The first crossed grid dipole has an interconnected plurality of arms. The antenna element also has a second crossed grid dipole, arranged in an X-Y plane corresponding to a second tier, the second crossed grid dipole having a plurality of non-interconnected arms, each of the non-interconnected arms having a feed input. Each arm has a central conductor and periphery conductors forming a perimeter that surrounds at least a portion of the central conductor. The first and second crossed grid dipoles are interconnected at corners on their peripheries but are unconnected at a central point. On the upper tier, each of the arms is connected at the central point, while on the lower tier the arms are connected to feeds at the center point. An array of such elements can be formed.

All dimensions and distances given herein are in the wavelength (λ) at exactly the highest frequency at which an array of elements can be scanned to 30 degrees off broadside in any direction without the formation of visible grating lobe peaks in the array factor. This frequency would usually be very close to the highest frequency of desired operation while scanning the array to 30 degrees off broadside. This frequency is referred to herein as the reference frequency. The dimensions given for the element described herein were optimized for a given set of requirements, which include no grating lobes with a 30 degree conical scan, circular polarization, independent control over two feed ports, octave bandwidth, a seven element array with air dielectric and thin conductors over a very highly conductive ground plane. Those of ordinary skill will recognize that a different set of requirements might advise somewhat different dimensions, but the fundamental geometric concept of the claimed antenna element would be the same.

Figure 4A:
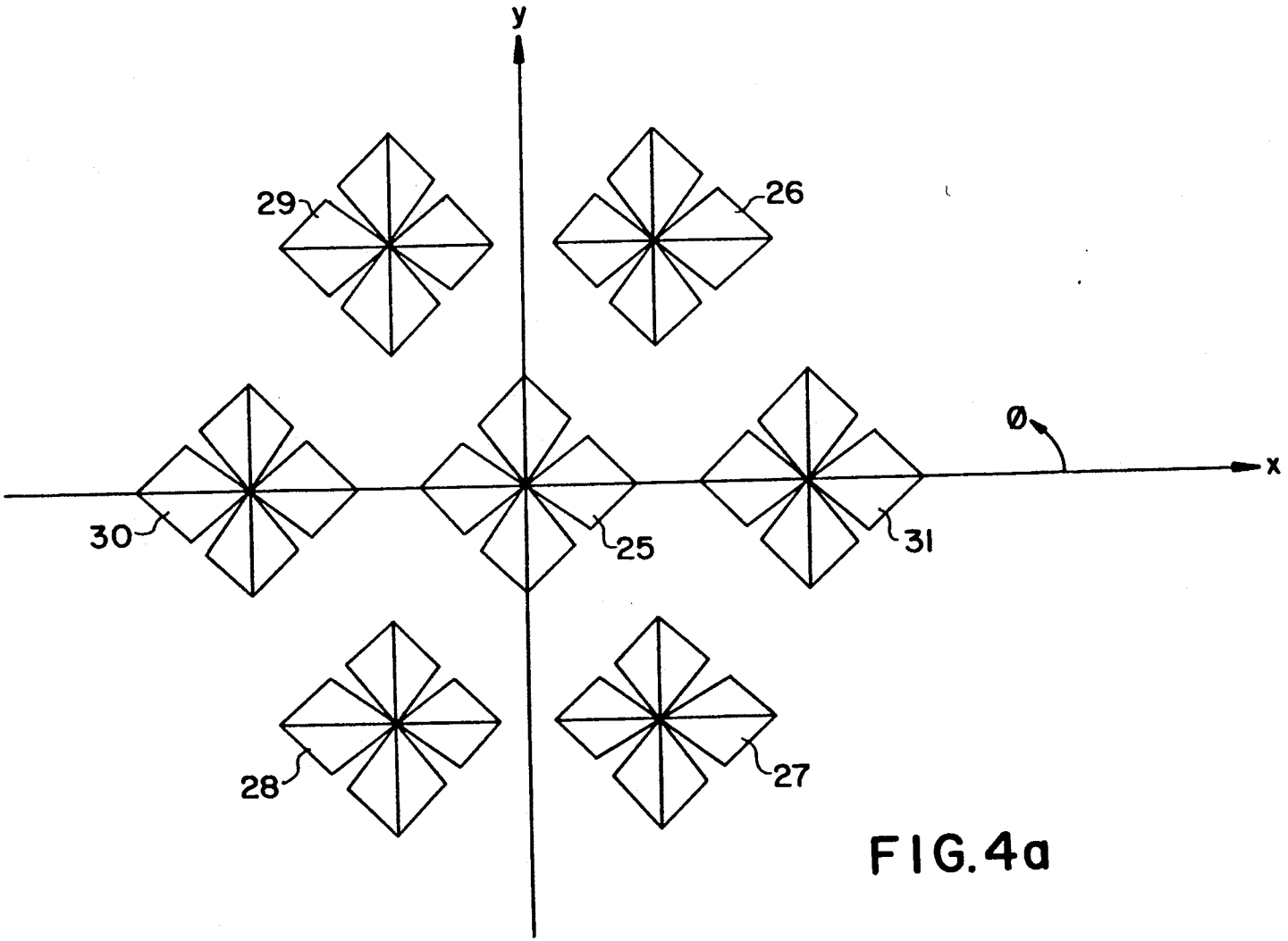
FIG. 4*a* shows a seven element array lattice employing antenna elements of the invention.
Figure 4B:
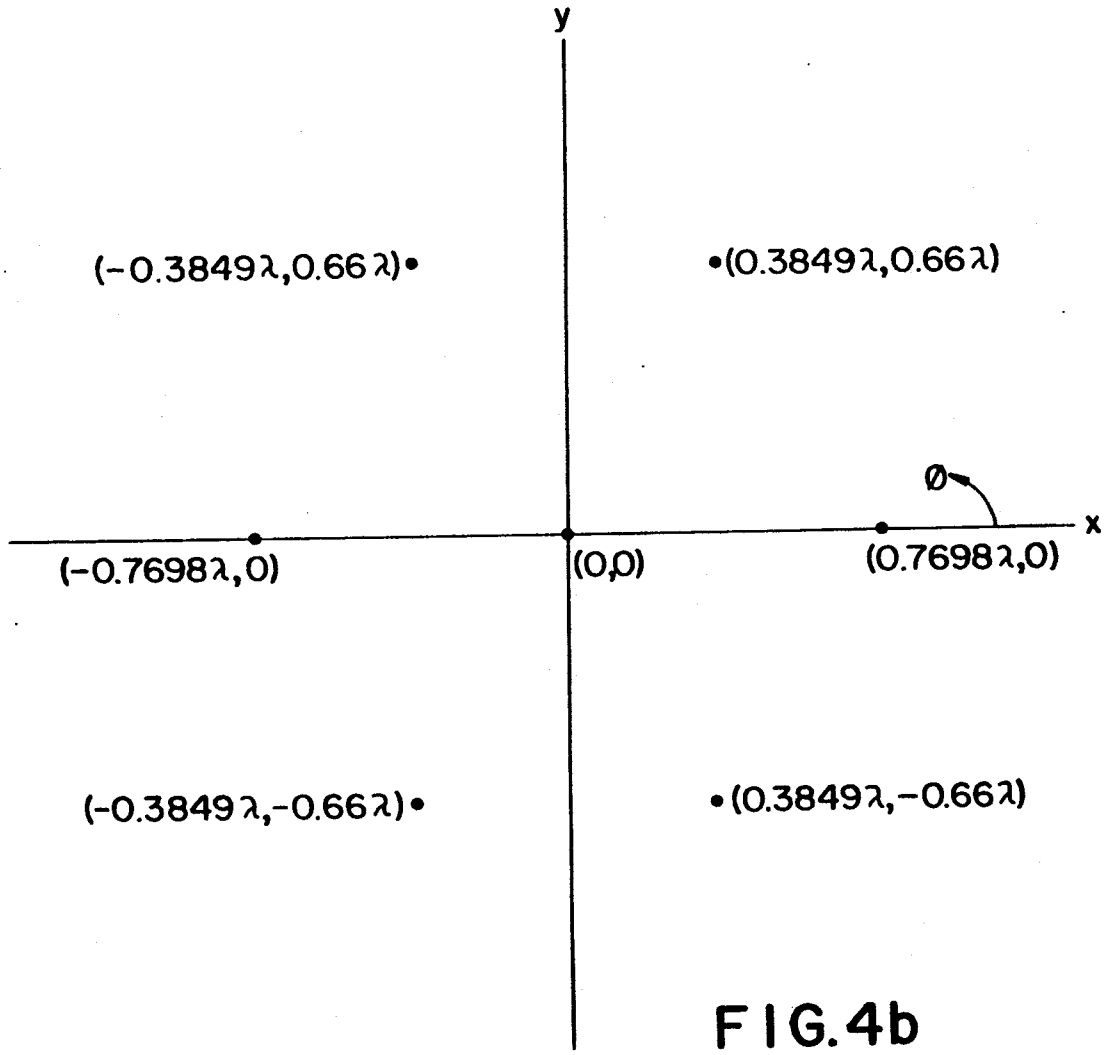
FIG. 4*b* identifies the center points of the antenna elements of the seven element array of FIG. 4*a;*

The antenna element disclosed herein is designed to be used, typically, in an array of 7 or more identical elements. The center points and orientations of the elements for the given requirements are shown in FIGS. 4*a* and 4*b*. Additional elements may be used by adding to the periodic element lattice shown in FIGS. 4*a* and 4*b*. Arrays with 7 elements and with 19 elements have been investigated. The 7 element array is described herein, although it will be known to those of ordinary skill that the scope of the claims herein includes arrays with other numbers of elements.

Since all elements in the array are identical, only one element need be described in detail. An antenna element according to the invention has two crossed grid dipoles. Each crossed grid dipole lies upon a planar surface, referred to as a tier. One of the crossed dipoles is arranged in a first tier and the second crossed dipole in the second tier. The two tiers are separated vertically and lie one above the other, parallel to each other, and parallel to a ground plane. The first tier is uppermost. The second tier lies between the first tier and the ground plane. The first tier may be referred to as the upper tier, and the second tier as the lower tier. The tiers are separated by air or non-conducting dielectric material.

Figure 1:
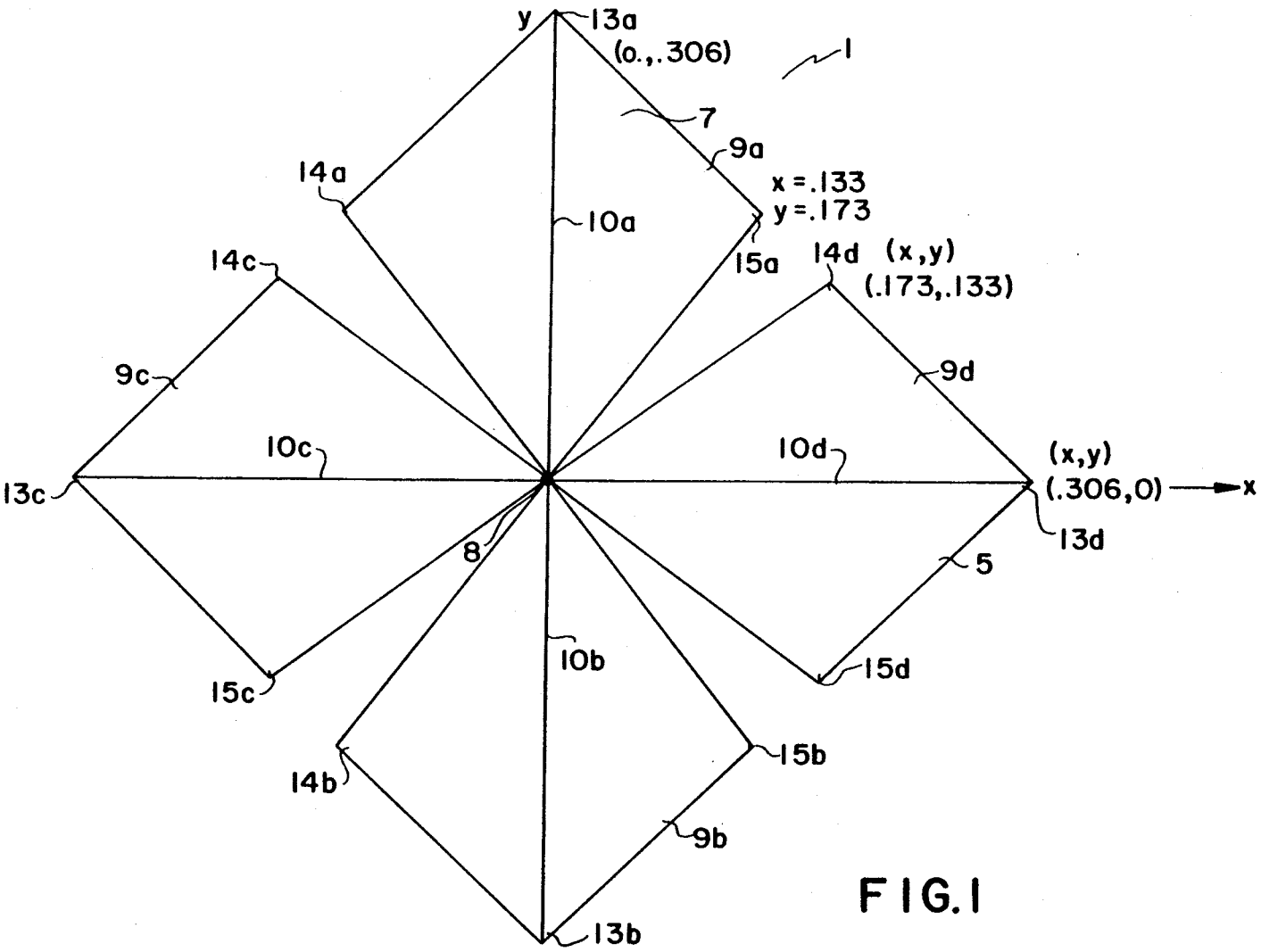
FIG. 1 is a top view of an upper tier of an antenna element according to the invention.
Figure 2:
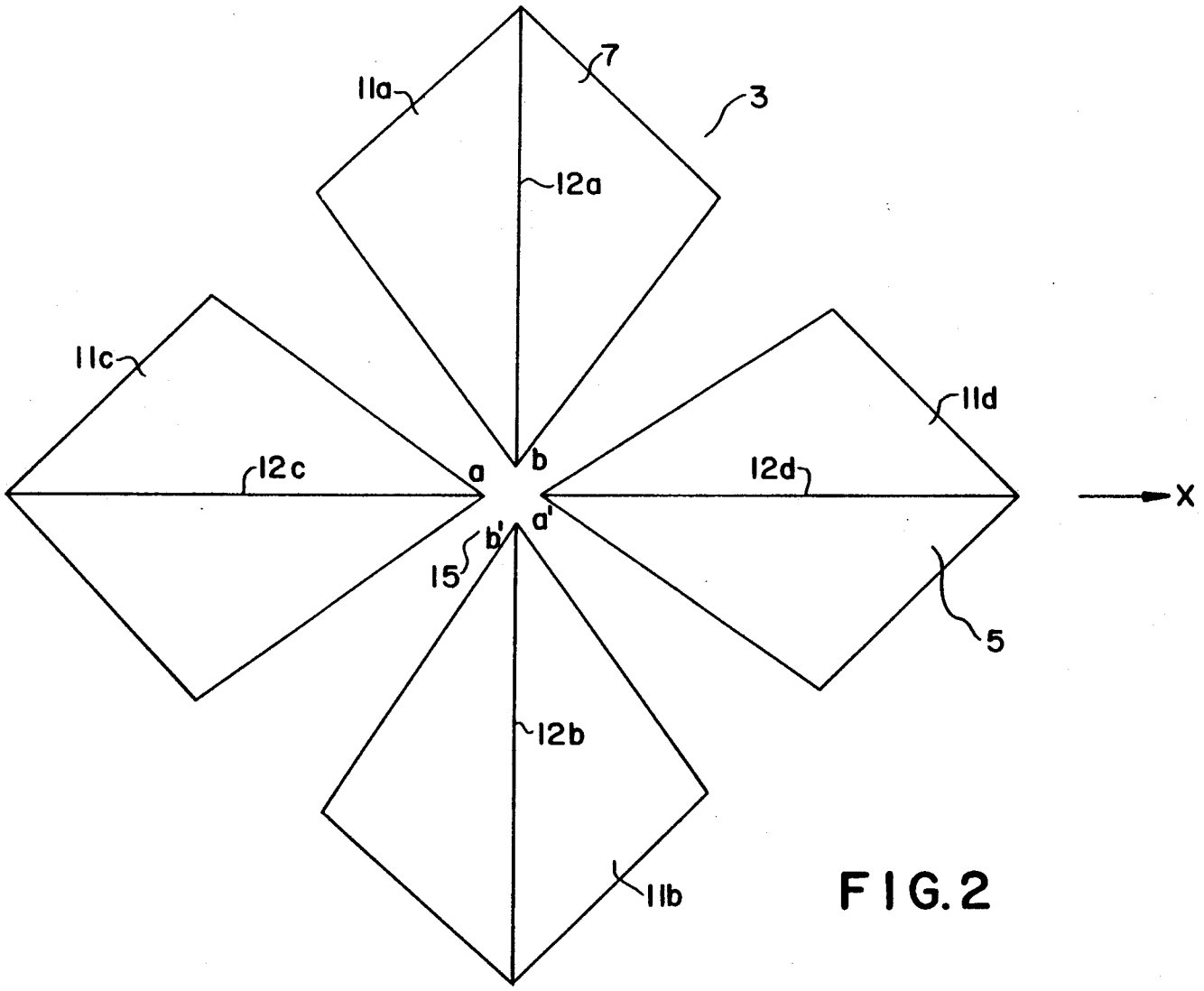
FIG. 2 is a top view of a lower tier of an antenna element according to the invention.
Figure 3:
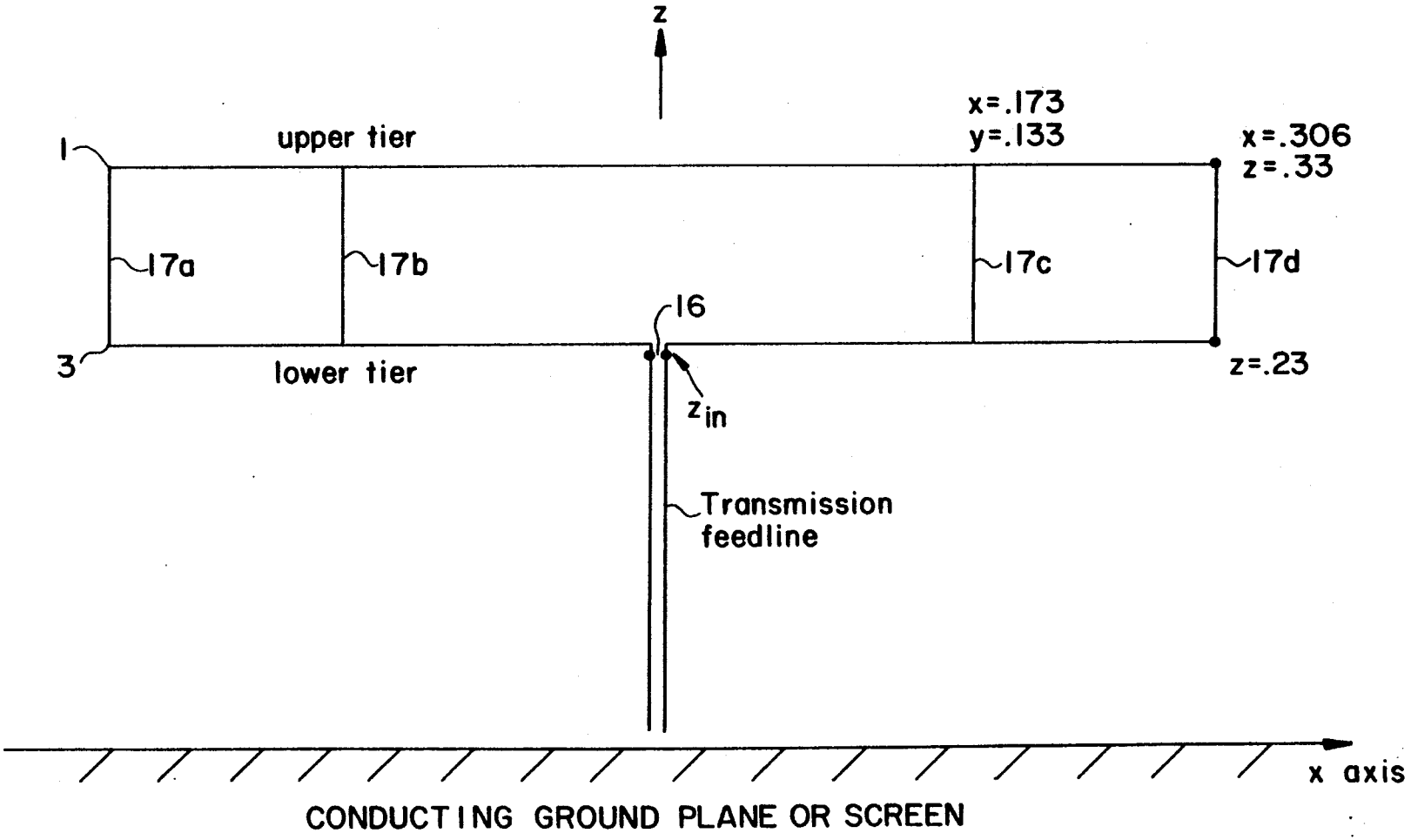
FIG. 3 is a side view of the antenna element of the invention.

The two tiers are laid out as shown in FIGS. 1 and 2 when viewed from the top. Each line drawn in the figures represents the location of a conductor such as a wire. All the wires or conductors in each tier lie in a plane parallel to the X-Y plane. The ground plane is in the X-Y plane and the Z axis is vertical. The side view of FIG. 3 shows the two tier construction of the element.

The element is comprised of two crossed grid dipoles, one per tier. Each crossed grid dipole is comprised of two grid dipoles. Each grid dipole is comprised of two arms, typically quadrilateral arms. Each quadrilateral arm is formed from four perimeter or peripheral conductors and one axial conductor. The axial conductors of each arm are positioned along the axis of the dipole. As shown in FIGS. 1 and 2, in each tier one dipole axis is oriented parallel to the X axis and a second dipole axis is oriented parallel to the Y axis.

The conductors may be identified as follows in FIGS. 1 and 2. On the upper tier, quadrilateral conducting grid arms 9*a* and 9*b* form one of the dipoles and quadrilateral arms 9*c* and 9*d* form the other one of the dipoles. All four arms 9*a*,9*b*,9*c* and 9*d* form the crossed dipole. Similarly, on the lower tier, conducting grid arms 11*a* and 11*b* form one of the dipoles and conducting grid arms 11*c* and 11*d* form the other one of the dipoles. Arms 11*a*,11*b*,11*c*, and 11*d* form the crossed grid dipole. The two dipoles on the upper tier have axial conductors 10*a*–10*b* or 10*c*–10*d*. The two dipoles on the lower tier have axial conductors 12*a*–12*b* or 12*c*–12*d*. The dipoles have additional conductors around a perimeter to produce the wide grid dipole shapes shown. Each of the dipoles is 0.612λ long at the reference frequency.

The first or upper tier is located 0.33λ above the ground plane and the lower tier is 0.23λ above the ground. Each element is symmetric about the X and Y axes, so the coordinates of all points may be deduced from the coordinates given.

In the first or upper tier the conductor grid arm 9*a* forms a quadrilateral having four sides with its furthest perimeter or periphery corner 13*a* along its respective axis 10*a* at a distance of 0.306λ from a common center 8 or interior corner. The remaining perimeter or periphery corners of quadrilateral arm 9*a* are shown at 14*a* and 15*a* and are located a distance of 0.133λ away from the axis and 0.173λ from the common center 8.

Similarly the conductor grid arm 9*b* forms a quadrilateral having four sides with its furthest perimeter or periphery corner 13*b* along its respective axis 10*b* at a distance of 0.306λ from a common center 8 or interior corner. Thus, the two quadrilateral arms 9*a* and 9*b* along the same axis 10*a*–10*b* form a dipole of 0.612λ long. The second dipole in FIG. 1 is formed from quadrilateral arms 9*c* and 9*d*, and has identical dimensions to dipole 9*a*–9*b* except that it lies along axis 10*c*–10*d*.

The lower tier (FIG. 2) has identical coordinates to the upper tier with two exceptions. The lower tier is located in a plane closer to the ground plane (lower Z coordinate) as shown in FIG. 3. Also, the lower tier is fed by a transmission line, so there is a small gap 15 between the quadrilateral arms on the lower tier to permit feeding from a balanced transmission line, in the manner of a turnstile antenna. FIG. 2 shows these feed points. One dipole on the lower tier formed by quadrilateral grids 11*c* and 11*d* is fed between points a and a', and the second dipole formed by quadrilateral grids 11*a* and 11*b* on the lower tier is fed between points b and b'; a–a' is one balanced input and b—b' is a second balanced input. To transmit circular polarization from the element the two balanced inputs are fed in quadrature phase.

The dipoles on the upper tier are not fed. Instead, all the 12 conductors converging at the center 8 are electrically connected together at the center 8 as shown in FIG. 1. This unconventional connection on the upper tier at the center of both dipoles has not previously been documented and is one of several novel features which differentiates this antenna element from existing designs.

With the quadrilateral arms shown, the top and bottom tiers are connected at 12 points on the periphery of the element by 12 vertical conductors 17*a*–17*d* located at each of the 12 perimeter corners (conductor junctions) on the periphery of the dipoles. Each quadrilateral arm is therefore connected at 3 points to the quadrilateral arm directly above or below it on the other tier. Each vertical conductor is 0.10λ long.

FIG. 3 shows a side view of one dipole on each tier and the vertical connections between them. The axis of the second dipole on each tier is orthogonal or out of the page. FIG. 3 also illustrates that the vertical connection between the tiers provides some features of a folded dipole, since the upper tier forms the folded portion of the folded dipole. A novel and unique feature of this element is that it combines the concept and operation of a crossed grid dipole with that of a folded dipole.

The antenna array element of the invention provides circular polarization and permits the minimum number of array elements for a scanning array while maintaining a relatively constant active element input impedance over a wide bandwidth approaching one octave.

FIG. 4 shows an equilateral triangular array lattice which has been shown to require the minimum number of array elements for grating lobe free scanning over a conical scan volume. See, Johnson and Jasik, *Antenna Engineering Handbook*, 1984, page 20–17, incorporated herein by reference. The array could be larger than the 7 elements shown in FIG. 4.

As shown in FIGS. 4*a* and 4*b*, the array is a repeating pattern of rows of antenna elements in an equilateral triangular lattice. The centers of the elements are separated in the X direction by 0.7698λ, where λ is the wavelength at the reference frequency. In the Y direction, the centers of the antenna elements are separated by 0.66λ. In alternating rows the elements are shifted in the x direction by 0.3846λ. Thus, if element 25 is centered at a particular location, elements 26–29 are centered at a location defined by 0.3846λ away in the X direction and 0.66λ away in the Y direction, since they are in rows adjacent to the row containing element 25. Elements 30 and 31 are located 0.7698λ away in the X direction and at the same coordinate as element 25 in the Y direction.

FIGS. 5 through 12 illustrates one of the main advantages provided by this array element, which is that the driving input impedance stays relatively constant over a wide bandwidth even in the scanned array environment. FIGS. 5 through 12 are Smith chart plots of input impedances (normalized to 350 Ohms) for each of the two orthogonal dipoles comprising the center element of the 7 element array. This impedance is taken at the antenna input to each individual dipole, as shown by the point marked "Zin" in FIG. 3. No matching components are used to obtain the impedances plotted.

The impedances plotted in FIGS. 5 through 12 are the impedance seen for the center dipoles with all 14 dipoles excited (both dipoles in all 7 elements) for circular polarization and for scan to some beam angle. This is sometimes known as the "active input impedance". Since the relative phase of each element is different for different beam scan angles, the input impedance of the center dipoles is also different for each beam scan angle due to mutual coupling effects.

Scan angles are measured from the Z axis, so zero degree scan is when the array beam is formed in the direction normal to the plane of the array (beam in the Z axis direction). This is also known as "broadside" scan.

Each dipole of the pair of dipoles in an element sees a different array environment. This can be seen in FIGS. 4*a* and 4*b*. The center dipole along the X axis sees adjacent elements at 0, 60, 120, 180 degrees relative to its axis. The center dipole oriented along the Y axis sees the adjacent elements at 30, 90, and 150 degrees off its axis. Due to these different locations of the surrounding elements relative to the two center dipoles, the two center dipoles have somewhat different active input impedances. Table I correlates the plots in FIGS. 5 through 12 to center dipole. The angle Phi listed in Table I is measured as shown in FIG. 4. Phi is used to identify which of the two center dipoles is being plotted, and also identifies the plane of scan for the given figure.

TABLE I

Identification of FIGS. 5–12*.

| Figure # | Dipole orientation (Phi) | Plane of scan (Phi) |
|---|---|---|
| 5 | 0 | 0 or 180 |
| 6 | 0 | 45 or −135 |
| 7 | 0 | 90 or −90 |
| 8 | 0 | 135 or −45 |
| 9 | 90 | 0 or 180 |
| 10 | 90 | 45 or −135 |
| 11 | 90 | 90 or −90 |
| 12 | 90 | 135 or −45 |

*The direction of the vector from the origin through the point in the XY plane defined by angle Phi identifies dipoles and planes of scan. Phi is in degrees from X axis as shown in FIG. 4

Figure 5:
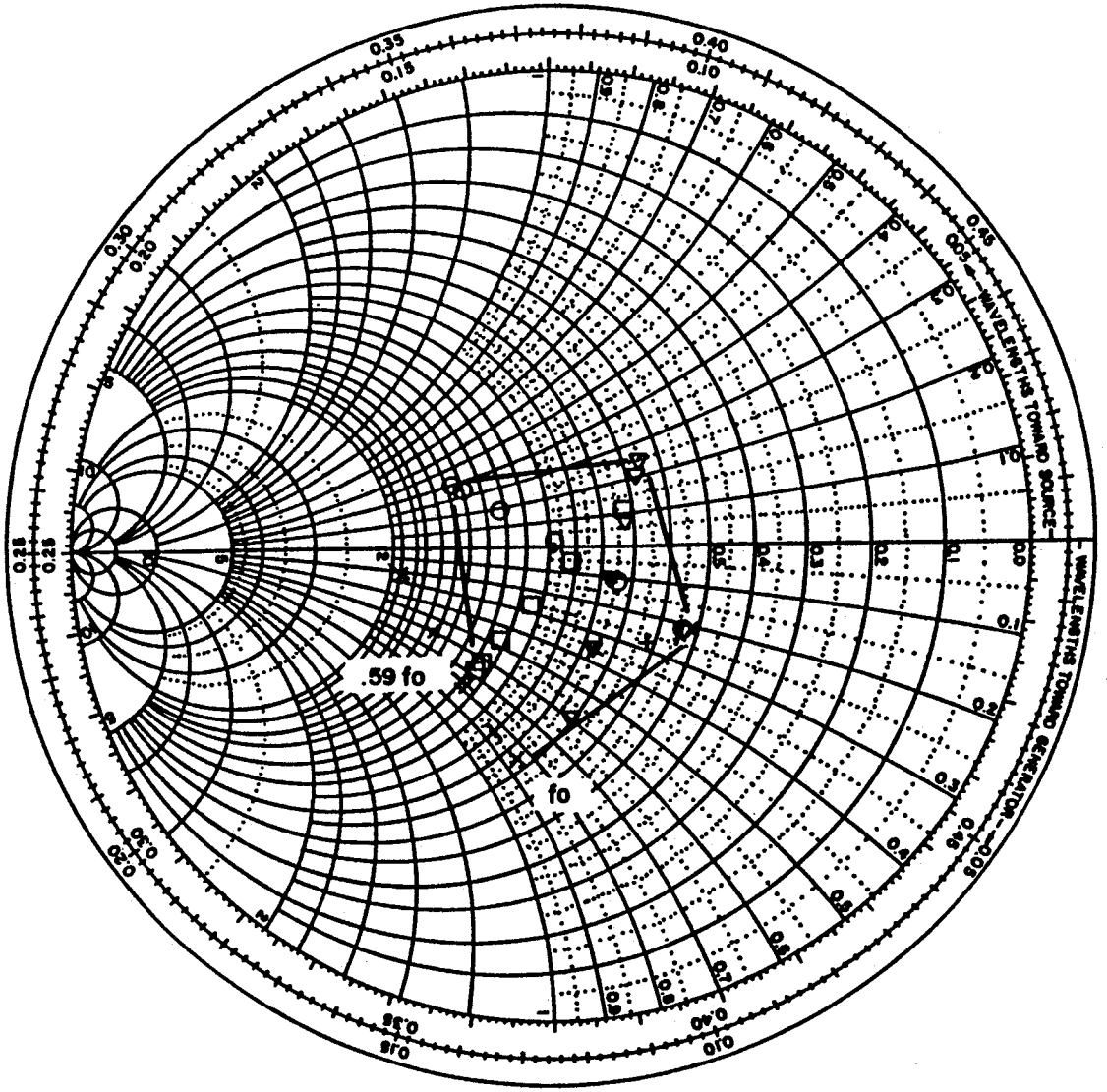
FIGS. 5–12 are Smith charts showing performance of the antenna elements under various conditions.
Figure 6:
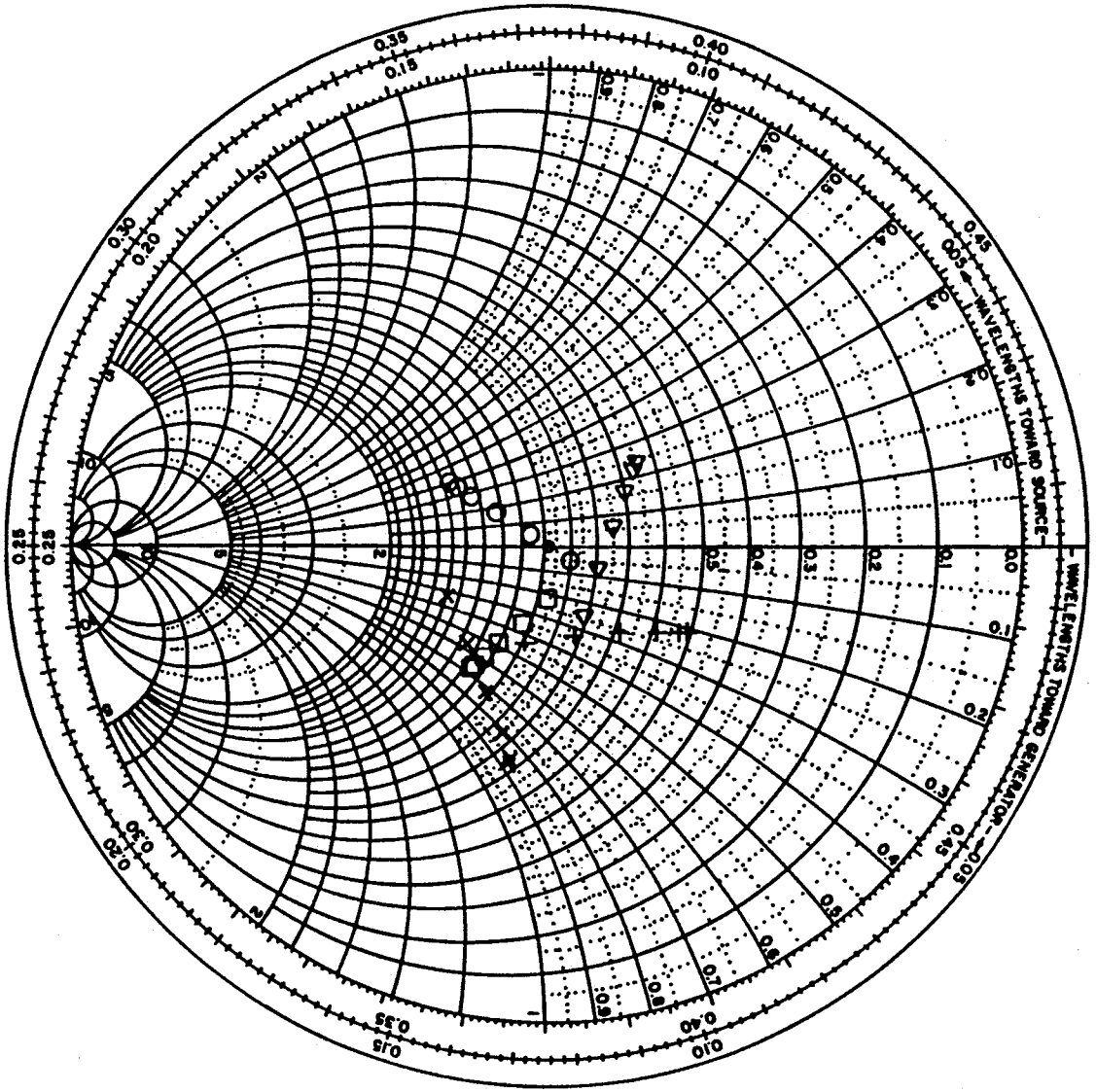
Figure 7:
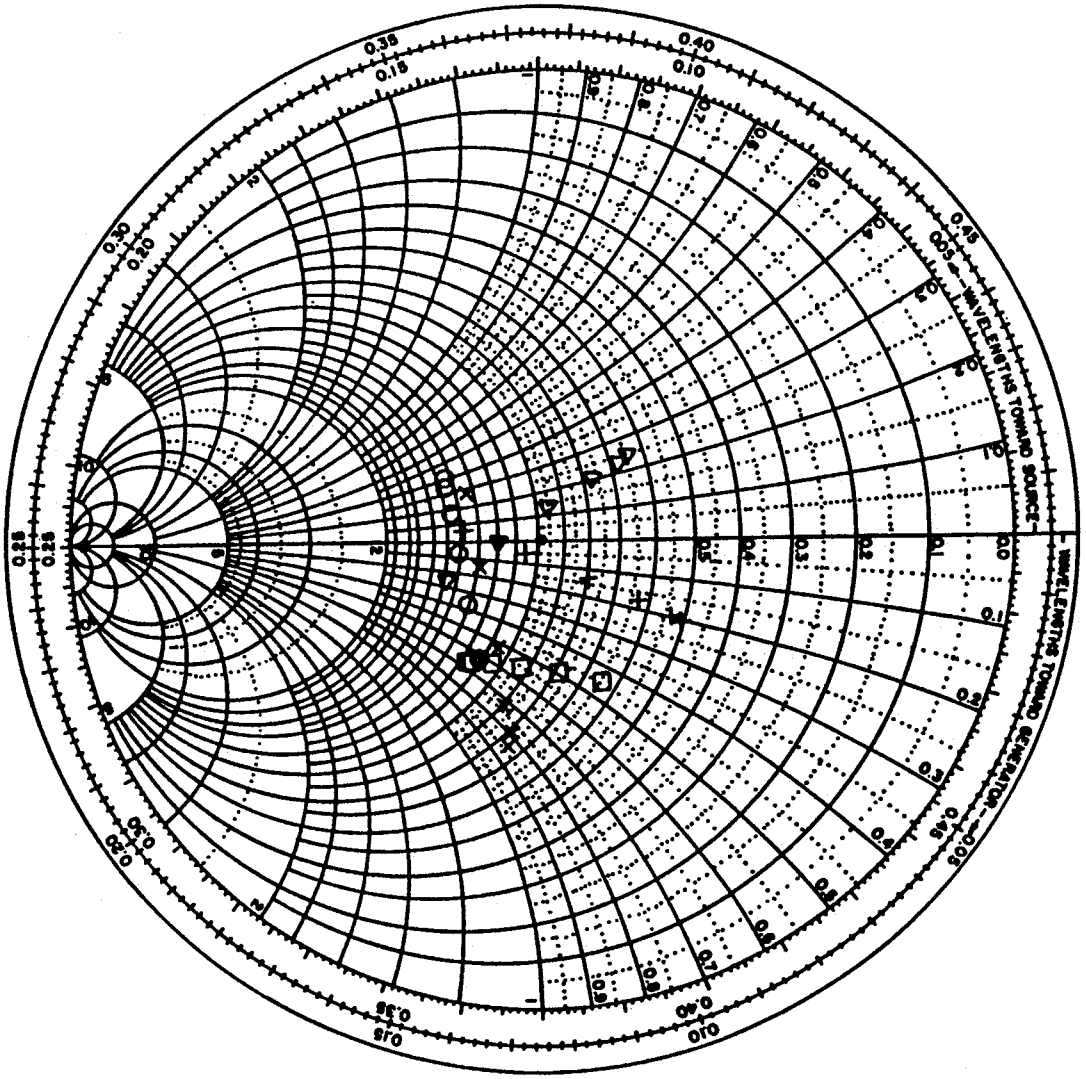
Figure 8:
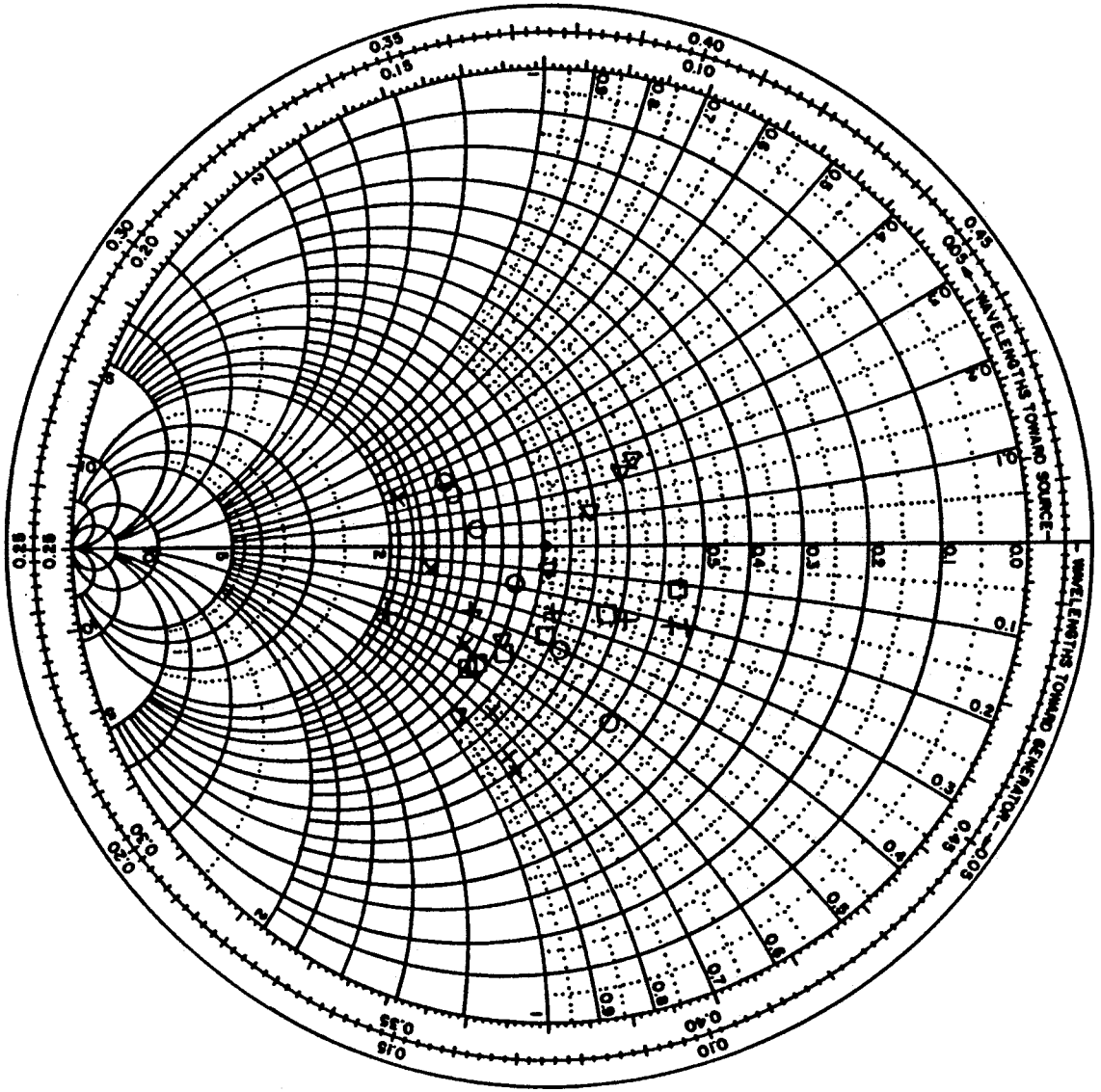
Figure 9:
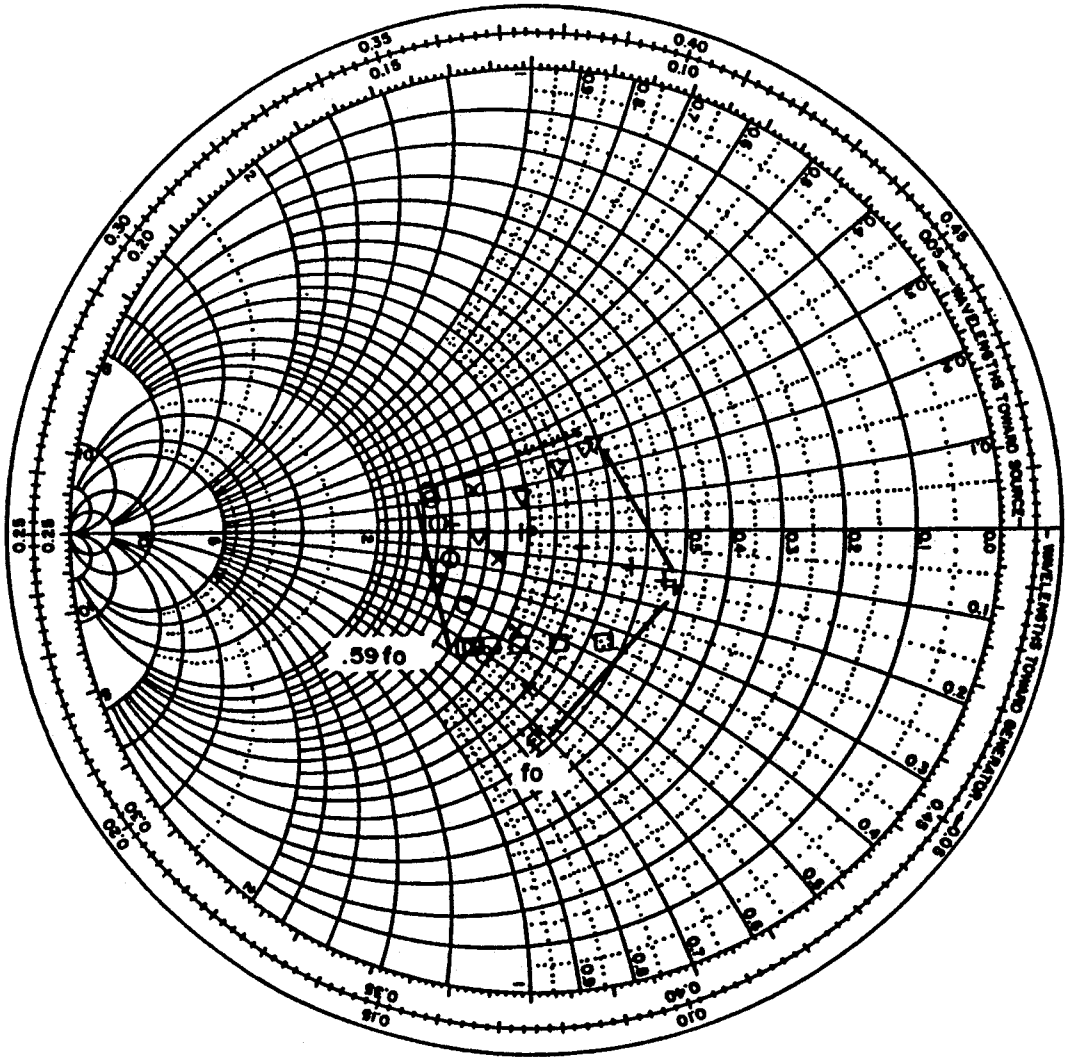
Figure 10:
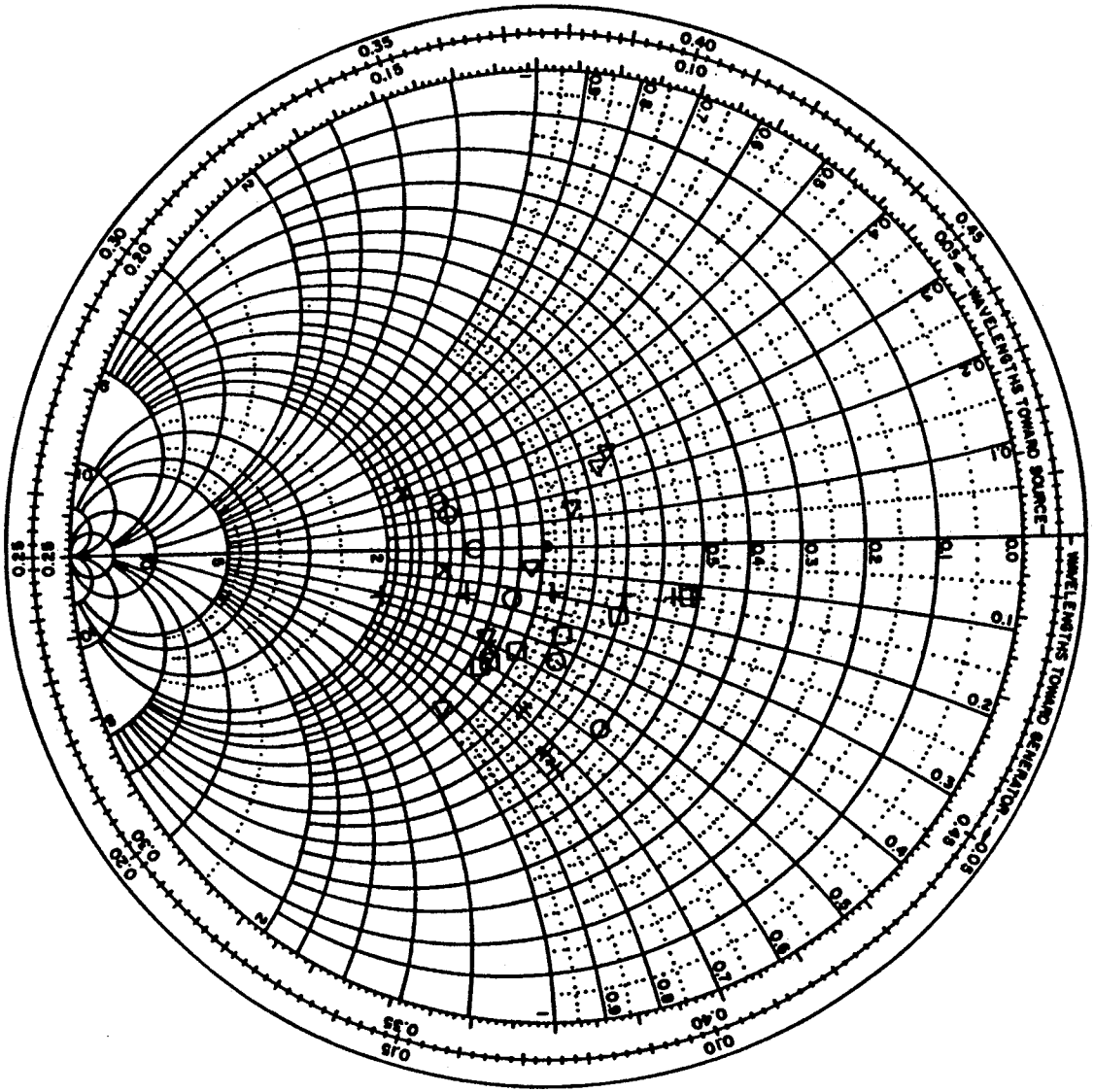
Figure 11:
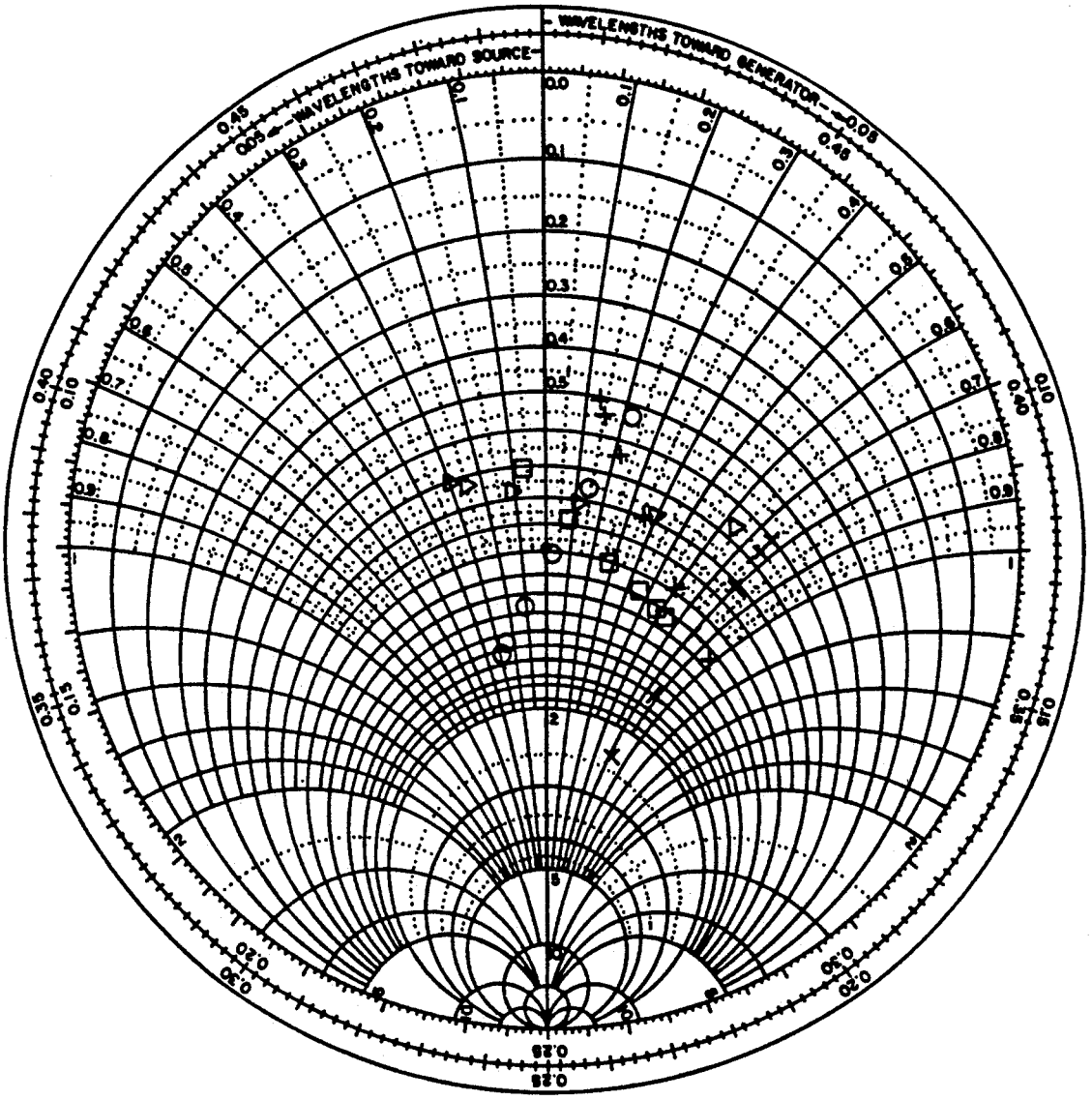
Figure 12:
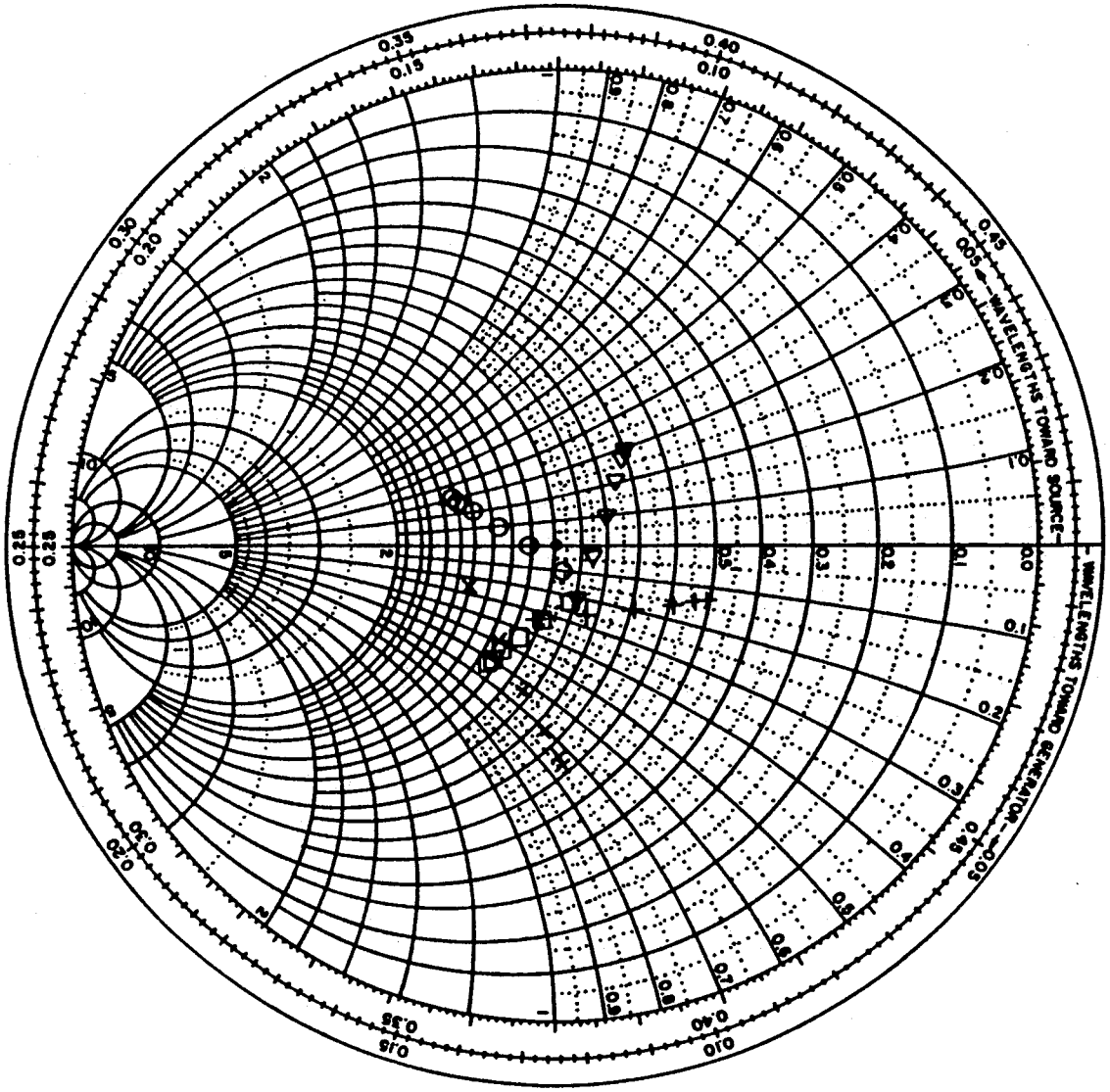

Each figure shows scan results from broadside to 30 degrees scan off broadside at each frequency. The legend identifies the frequencies plotted, where λ is the reference frequency defined above. The reference frequency is the highest frequency plotted. The lowest frequency plotted is 0.59 of the reference frequency. The other three frequencies are intermediate frequencies. The broadside scan point is marked on FIGS. 5 and 9 by the solid line connecting the broadside points across the frequency band. As shown, as the frequency is swept across the band from low to high frequency the broadside impedance follows a clockwise rotation about the center of the chart. FIG. 5 is for the dipole parallel to the X axis and FIG. 9 is for the dipole parallel to the Y axis. FIGS. 6, 7, and 8 have the same broadside impedance as FIG. 5 since they are for the same dipole, and FIGS. 10, 11, and 12 have the same broadside points as FIG. 9. The other points (scanned impedance points) differ on each figure, since the planes of scan are different. The farthest point from broadside at each frequency is the 30 degree scan point.

The results shown in FIGS. 5 through 12 were obtained from an accurate computer model using the Lawrence Livermore NEC-2 Method of Moments computer code. The NEC-2 computer code is widely used to computer model electromagnetic phenomena including a wide variety of antenna types, and it has been extensively verified as accurate for structures comprised of wires surrounded by air. The NEC-2 model includes mutual coupling effects between the array elements.

The antenna according to the invention is a synthesis of features found in three known antennas, with some novel and unique features added which are not found in any known antenna. The three precursors are: the crossed dipole (or turnstile antenna), the folded dipole, and the wire biconical antenna. These three known antennas are described in antenna texts and handbooks as discussed above. These precursors to the present invention are used for a variety of communication and radar applications, both singly and in an array. The instant invention combines some features similar to those of the above three precursors, with the novel and unique feature that the top (folded) arms of the pair of dipoles are joined together electrically at the center. The design is also simplified for ease of mechanical construction to the extent possible by placing the conductors in two planar tiers. The resulting element is unique and provides greatly improved bandwidth in the array environment.

The computer modeling has shown that an array of these elements permits the use of the minimum number of elements for grating lobe free operation over a conical scan volume while also maintaining an unusually wide impedance bandwidth.

While specific embodiments of the invention have been described and illustrated, it will be clear that variations in the details of the embodiments specifically illustrated and described may be made without departing from the true spirit and scope of the invention as defined in the appended claims.

What is claimed is:

1. An antenna element comprising:

a ground plane a first crossed grid dipole, said first crossed grid dipole being arranged in an X-Y plane corresponding to a first tier, the first tier being vertically separated from a second tier and said ground plane, said second tier being located between said ground plane and said first tier, the first crossed grid dipole having an interconnected plurality of arms;

a second crossed grid dipole, said second dipole arranged in an X-Y plane corresponding to said second tier, said second crossed grid dipole having a plurality of non-interconnected arms, each of said non-interconnected arms having a feed input; and said first crossed grid dipole being connected to said second crossed grid dipole by conductors.

2. An antenna element as recited in claim 1 wherein each said arm of said first crossed grid dipole and said second crossed grid dipole comprises a central axial conductor and perimeter conductors surrounding at least a portion of said central conductor.

3. An antenna element as recited in claim 2 wherein said perimeter conductors of each said arm are arranged to form a polygon having a plurality of sides joined at periphery corners and having one center corner.

4. An antenna element as recited in claim 3, wherein said polygon is a quadrilateral with sides joined at four corners.

5. An antenna element as recited in claim 4 wherein each of said arms on said first tier is connected to corresponding said arms on said second tier at three of said four corners by vertical conductors, said three connected corners being on a periphery of said arm, the fourth corner being a center corner not connected between the tiers and being located at a center of said first and second crossed grid dipole.

6. An antenna element as recited in claim 4 wherein said center corners of said arms of said first tier are interconnected at a common point on said first tier.

7. An antenna element as recited in claim 6 wherein said common point forms a center of said element, said common point being located on said first tier along a central vertical axis parallel to the Z axis passing through a center between said feed inputs on said second tier.

8. An antenna element as recited in claim 5 wherein said three connected corners of each arm are connected by vertical conductors having a length of about 0.10λ, where λ is a wavelength at a reference frequency.

9. An antenna element as recited in claim 7 wherein one of said corners of each said polygon is a far periphery corner located at a distance of about 0.306λ from said common point.

10. An antenna element as recited in claim 7 wherein said corners of said polygon further comprise a pair of corners symmetrically arranged around said central axial conductor, each corner of said pair being located at a coordinate having a distance of about 0.173λ along said central axial conductor from said common point, and a distance of about 0.133λ perpendicular from said central conductor.

11. An antenna element as recited in claim 1 wherein said ground plane is separated from said second tier by a distance of about 0.23λ.

12. An antenna element as recited in claim 1 wherein said first tier, said second tier and said ground plane are separated by air.

13. An antenna element as recited in claim 1 wherein a distance separating one of said first tier, said second tier and said ground plane is filled with dielectric material.

14. An antenna element as recited in claim 2 wherein said perimeter conductors and said central axial conductor are separated by air.

15. An antenna element as recited in claim 1 wherein said arms are separated by dielectric material.

16. An antenna element as recited in claim 1 wherein said arms are separated by air.

17. An antenna element comprising:

a ground plane first and second crossed grid dipoles located on first and second tiers, respectively, of said element, said second tier being interposed between said ground plane and said first tier at a first distance from said first tier, and a second distance from said ground plane;

said first crossed grid dipole having a plurality of arms formed by conductors, each of said arms being connected at an interconnection point located at an approximate central vertical axis parallel to the Z axis of said element;

said second crossed grid dipole having a plurality of non-interconnected arms formed by conductors, said conductors forming periphery corners at distances from said central vertical axis, said periphery corners being substantially vertically aligned and electrically connected to periphery corners formed by said conductors of said first crossed dipole, said conductors of said second crossed dipole arms further forming a single feed point for each arm, said single feed points surrounding said central vertical axis.

18. An antenna element as recited in claim 17 wherein said conductors forming said arms of said first and second crossed grid dipoles are arranged to configure each arm as a quadrilateral.

19. An antenna element as recited in claim 17 wherein said first and second distances and said distances from said central vertical axis to said periphery corners, are determined from a wavelength, λ, corresponding to a highest operational frequency which permits conically scanning an array of said elements to about 30 degrees off broadside with no grating lobe formation using an equilateral triangular lattice of elements.

20. An antenna element as recited in claim 19 wherein said first distance is about 0.10λ, and said second distance is about 0.23λ.

21. An antenna element as recited in claim 20 wherein each said arm of said first crossed dipole has a central axial conductor located along a dipole axis perpendicular to said central vertical axis, between said central vertical axis and one of said periphery corners of said arm located a furthest distance from said central vertical axis.

22. An antenna element as recited in claim 20 wherein one of said periphery corners of each arm of said first crossed grid dipole and said second grid crossed dipole is a far corner located at distance of about 0.306λ from said central vertical axis along a dipole axis perpendicular to said central vertical axis.

23. An antenna element as recited in claim 22 wherein a pair of perimeter corners of each arm of said first crossed grid dipole and said second crossed grid dipole are symmetrically located at coordinates of about 0.173λ along said axis perpendicular to said central vertical axis and about 0.133λ perpendicular to said dipole axis perpendicular to said central vertical axis.

24. An antenna element as recited in claim 23 wherein each arm of said second crossed grid dipole further includes a central conductor along said dipole axis perpendicular to said central vertical axis, said central conductor connecting said far corner to one of a said feed input and said interconnection point.

25. An array of antenna elements, each element of the array comprising:

a ground plane;

a first tier about 0.33 wavelengths above the ground plane and having a crossed grid dipole joined at a central point; and a second tier located between the ground plane and the first tier at about 0.23 wavelength from the ground plane and having a crossed grid dipole vertically aligned with the crossed grid dipole of the first tier, the crossed grid dipole of the second tier being electrically connected at exterior perimeter corners to the crossed grid dipoles of the first tier, interior corners of the grids of the second tier being non-interconnected and connectable to antenna feeds.

26. An array of antenna elements as recited in claim 25 wherein the elements are placed in an equilateral triangular lattice which consists of a repeating pattern of parallel alternating rows, each element center in each row is positioned 0.7698λ from adjacent element centers in the row in a first direction and 0.66λ from adjacent rows in a second direction, the element centers in adjacent rows being located in the first direction midway between each other, and wherein λ is a wavelength corresponding to a reference highest frequency which permits scanning the array to 30 degrees in any direction off broadside with no grating lobes.

27. A method of radiating electromagnetic energy in an arbitrary direction over a predetermined wide angular region and over a wide frequency range, the method comprising the steps of:

feeding an antenna element having a ground plane a first crossed grid dipole, said first crossed grid dipole being arranged in an X-Y plane corresponding to a first tier, the first tier being vertically separated from a second tier and said ground plane, said second tier being located between said ground plane and said first tier, the first crossed grid dipole having an interconnected plurality of arms;

a second crossed grid dipole, said second dipole arranged in an X-Y plane corresponding to said second tier, said second crossed grid dipole having a plurality of non-interconnected arms, each of said non-interconnected arms having a feed input, said first crossed grid dipole being connected to said second crossed grid dipole by conductors; and connecting said element to a transmitter.

28. A method of receiving electromagnetic energy from an arbitrary direction over a predetermined wide angular region and over a wide frequency range, the method comprising the steps of:

feeding an antenna element having a ground plane a first crossed grid dipole, said first crossed grid dipole being arranged in an X-Y plane corresponding to a first tier, the first tier being vertically separated from a second tier and said ground plane, said second tier being located between said ground plane and said first tier, the first crossed grid dipole having an interconnected plurality of arms;

a second crossed grid dipole, said second dipole arranged in an X-Y plane corresponding to said second tier, said second crossed grid dipole having a plurality of non-interconnected arms, each of said non-interconnected arms having a feed input, said first crossed grid dipole being connected to said second crossed grid dipole by conductors; and connecting said element to a receiver.

* * * * *